US012799726B2

(12) United States Patent
Peters

(10) Patent No.: US 12,799,726 B2
(45) Date of Patent: Nov. 17, 2026

(54) WATER RECYCLING SYSTEM FOR TOILETS

(71) Applicant: James Peters, Lehigh Acres, FL (US)

(72) Inventor: James Peters, Lehigh Acres, FL (US)

( * ) Notice: Subject to any disclaimer, the term of this patent is extended or adjusted under 35 U.S.C. 154(b) by 160 days.

(21) Appl. No.: 18/770,670

(22) Filed: Jul. 12, 2024

(65) Prior Publication Data

US 2025/0019951 A1 Jan. 16, 2025

Related U.S. Application Data

(60) Provisional application No. 63/513,552, filed on Jul. 13, 2023.

(51) Int. Cl.
*E03D 5/00* (2006.01)
*E03B 1/04* (2006.01)

(52) U.S. Cl.
CPC ..... *E03D 5/006* (2013.01); *E03B 1/042* (2013.01); *E03B 2001/045* (2013.01)

(58) Field of Classification Search
CPC ..... E03D 5/006; E03D 5/003; E03B 1/042; E03B 2001/045
See application file for complete search history.

(56) References Cited

U.S. PATENT DOCUMENTS

| | | | | |
|---|---|---|---|---|
| 1,134,556 | A * | 4/1915 | Recker | E03D 9/007 4/228.1 |
| 6,408,450 | B2 * | 6/2002 | Giaimis | A47G 7/06 4/353 |
| 8,024,823 | B2 * | 9/2011 | Sanaghan, Jr. | E03D 1/22 4/363 |
| 9,732,503 | B1 * | 8/2017 | Erbach | E03D 5/003 |
| 9,932,147 | B1 * | 4/2018 | Ahlm | B65D 69/00 |
| 2020/0318332 | A1 * | 10/2020 | Christian | E03B 7/045 |

* cited by examiner

*Primary Examiner* — Janie M Loeppke
(74) *Attorney, Agent, or Firm* — Bryan L. Loeffler, Esq.; LOEFFLER IP GROUP, P.A.

(57) ABSTRACT

The present invention is directed towards a toilet water reclamation system that conserves water by using reclaimed water. The system comprises a first receptacle that nests into a second receptacle, which is secured to the toilet tank cover. Shower water, or other water, is collected in the first receptacle and allowed to sit until it is ready to be used. When the toilet is flushed, the first receptacle is lifted from the second receptacle and its contents are poured into the second receptacle. The second receptacle has an aperture to allow the passage of the water into the toilet tank, replacing the flushed water.

1 Claim, 7 Drawing Sheets

WATER RECYCLING SYSTEM FOR TOILETS

CROSS-REFERENCE TO RELATED APPLICATION

This application is related to, and claims benefit to U.S. Provisional Patent Application Ser. No. 63/513,552, filed Jul. 13, 2023, entitled Water Recycling System for Toilets, the entirety of which is incorporated herein by reference.

FIELD OF THE INVENTION

The present invention relates to the field of water conservation, and more particularly to a system and method for reclaiming and utilizing water that is normally wasted during showering, for the purpose of flushing toilets.

BACKGROUND OF THE INVENTION

Water is a precious natural resource, and its responsible use and management are of paramount importance in ensuring the long-term availability of clean water for future generations. In many parts of the world, including even the United States, water scarcity is, or is becoming, a significant issue, and the need for efficient and/or reduced water usage has become increasingly important. A substantial amount of water is consumed in households, with a large portion being used for activities such as showering and flushing toilets.

Conventional toilet systems typically rely on the use of fresh water to flush waste, which contributes to the inefficient use of water resources. In recent years, various efforts have been made to develop water-saving technologies. Such efforts include low-flow toilets and dual-flush systems. However, these solutions often still require a significant amount of water to operate effectively.

One of the largest contributors to water consumption in households is toilet flushing, which typically utilizes clean, potable water even though the process does not require such a high level of purity. Various attempts have been made to reduce water usage for toilet flushing, such as implementing low-flow toilets or dual-flush systems. However, these solutions do not address the issue of utilizing potable water for a task that could potentially be performed using non-potable water.

To further improve water conservation efforts, it is desirable to develop a system that can utilize reclaimed water for toilet flushing, reducing the demand for fresh water and helping to alleviate the burden on water supply systems. One potential source of reclaimed water is shower water, which, while not suitable for drinking, can be effectively used for toilet flushing.

Some other existing systems have been developed to collect shower water for reuse in toilet flushing, but these systems often involve complex plumbing, one-way valves, installations, pumps, pipes, switches, and electronics, which makes them expensive and difficult to implement, particularly in existing structures. Some of these existing systems would require power and permits to install. Furthermore, these systems may not be easily adaptable to different bathroom configurations or all toilet designs. Yet further, these existing systems may necessitate regular maintenance and monitoring to ensure water quality and system performance.

There is, therefore, a need for a water reclamation system that can efficiently collect, store, and utilize shower or washing water for toilet flushing, while being simple in design, easy to install, and adaptable to various bathroom configurations and toilet designs. Such a system could contribute to significant water savings, thereby mitigating the negative impacts of water scarcity on households and the environment. The current invention aims to overcome the limitations of prior technology by providing a simple, cost-effective, and easily implementable system that can effectively reclaim and utilize shower water for toilet flushing without wasting clean valuable water.

SUMMARY OF THE INVENTION

The present invention advantageously provides a device, a system and method for reclaiming and utilizing water that is normally wasted during showering or washing, for the purpose of flushing toilets.

The invention relates to a system for reclaiming water that would otherwise be lost down the drain during a shower, by collecting and storing the water in a first receptacle that nests into a second receptacle. The second receptacle is secured to the toilet tank cover and has a hole that allows water to pass through into the toilet tank during flushing.

This system provides an innovative solution for conserving water, reducing water waste and providing a more sustainable solution for the environment. With this invention, homeowners can take advantage of the water that is wasted during a shower by using it to flush toilets, thus reducing the amount of fresh water required for this purpose.

The present invention advantageously provides a water reclamation system for utilizing shower or washing water in toilet flushing, thereby conserving potable water resources. The system comprises a first removable receptacle, a second permanent receptacle secured to the toilet, such as secured to the toilet water tank cover, and a mechanism for transferring water between the receptacles to facilitate toilet flushing.

In one non-limiting embodiment of the present invention, the first receptacle is configured to collect and store shower water. Once shower water is collected, the user can place the first receptacle partially within the second receptacle for storage. The first receptacle may be designed to accommodate a volume of water sufficient for one or more toilet flushes. The first receptacle may include one or more handles or other suitable means for lifting and transporting the receptacle between the shower and the second permanent receptacle.

In another non-limiting embodiment of the present invention, the first receptacle is configured to nest within the second receptacle when not in use, thereby minimizing the space occupied by the system. The second receptacle may be provided with a securement mechanism, such as hooks, clasps, or straps, for attaching the second receptacle to a toilet tank cover. This securement mechanism ensures stability and proper positioning of the second receptacle during toilet flushing.

The second receptacle further comprises an aperture or hole for allowing the passage of water from the second receptacle into the toilet tank when the toilet is flushed. The aperture may be designed to provide a controlled flow of water into the toilet tank, preventing splashing or spillage. Additionally, the aperture may be provided with a closure mechanism, such as a valve or a cap, to prevent water leakage when the second receptacle is not in use.

In operation, a user collects shower water in the first receptacle before, during, and/or after showering. When the toilet is to be flushed, the user flushes the flush lever or pushes the flush button, then lifts the first receptacle from the second receptacle and pours the reclaimed shower water from the first receptacle into the second receptacle. The water in the second receptacle then flows through the aperture and into the toilet tank, providing the necessary refilling the toilet tank and/or flushing action. Once the flushing process is complete, the user can then reposition the first receptacle within the second receptacle, preparing the system for the next collection of shower water.

The water reclamation system of the present invention may be constructed from various materials, including but not limited to plastic, metal, or composite materials. The materials should be selected to ensure durability, resistance to corrosion, and compatibility with the reclaimed water.

In some embodiments, the first and second receptacles may be provided with graduated markings to indicate the volume of water contained therein. This feature allows users to monitor their water usage and optimize the amount of reclaimed water used for each flush.

Optionally, the water reclamation system may be equipped with a filtration mechanism for removing debris, hair, or other contaminants from the reclaimed shower water. This filtration mechanism may be located within the first receptacle, the second receptacle, or at any point along the transfer path between the receptacles.

In a further optional embodiment, the water reclamation system may include a disinfection mechanism, such as a UV light or chemical treatment, for ensuring the cleanliness and safety of the reclaimed shower water. The disinfection mechanism may be integrated into the first receptacle, the second receptacle, or within the transfer path between the receptacles.

By utilizing the water reclamation system of the present invention, households can significantly reduce their potable water consumption for toilet flushing, thereby contributing to water conservation efforts and reducing the overall environmental impact of water use. The simple design and operation of the system allow for easy implementation in a wide range of residential settings, including older homes and apartments where more complex plumbing modifications may not be feasible.

Furthermore, the water reclamation system of the present invention offers a cost-effective and user-friendly solution for conserving water resources. The easily accessible components and straightforward operation make the system suitable for users of varying ages and physical abilities, whether left or right-handed. The compact design and nesting feature of the receptacles ensure minimal space requirements, making the system an attractive option for smaller living spaces or bathrooms with limited storage.

In addition to residential applications, the water reclamation system may be adapted for use in commercial or public settings, such as office buildings, hotels, or schools, where water conservation efforts are of particular importance. The system may be customized to accommodate larger volumes of water or to integrate with existing plumbing infrastructure, as needed.

In one alternative non-limiting embodiment, the first receptacle may be provided with materials of a variety of colors and/or indicia to indicate to users the type of water collected. For example, the first receptacle may be formed in the colors white, green, and gray to indicate the source of the water, where white indicates a container for collecting clean drinkable water as water collected or rescued from going down the drain while waiting for a shower, bath or sink to warm up and removed prior to use of the shower or sink. Gray indicates a container for collecting gray water or used water, as water that had already been used for washing or shampooing, collected while showering, yet still perfect for flushing the recycling toilet. Green indicates water collected from outside sources such as rainwater or water from a gutter downspout or air conditioner condensate outflow. The visual cues provided by the colored materials facilitate efficient management and utilization of the collected water, promoting environmental and sustainability resource conservation.

The present invention, through its innovative design and ease of use, provides a practical and efficient solution for water reclamation and conservation. By repurposing shower water for toilet flushing, the system enables households and other establishments to significantly reduce their potable water consumption, ultimately contributing to a more sustainable and environmentally responsible approach to water use.

The present invention relates to a water recycling system for toilets designed to conserve water by reusing water from various household activities. This system includes a first receptacle and a second receptacle, wherein the first receptacle collects water from activities such as showering, bathing, and using a sink, and is specifically adapted to be versatile in collecting from these various sources.

The first receptacle is designed to nest within a second receptacle, which is securely attached to a toilet tank cover. This setup allows for the efficient transfer of water from the first to the second receptacle, facilitating the use of reclaimed water to refill the toilet tank after flushing. An aperture on the second receptacle ensures the controlled passage of water into the toilet tank.

The water recycling system is adaptable to different toilet models and bathroom configurations, highlighting its versatility. It also includes visual indicators on the first receptacle to differentiate types of collected water, such as potable versus non-potable sources, further enhancing its usability and effectiveness in various settings.

In one non-limiting embodiment, the second receptacle features an innovative structural design with an outer wall and a bottom that extends into an inner central aperture, leading to a throat equipped with male reciprocating threading. This threading interfaces with a lower drain nut, optionally secured by washers, to create a channel through which water flows into the toilet tank. The throat's design ensures a tight seal between the second receptacle and the toilet tank lid, preventing leaks as the water passes through the toilet lid before there are any breaks in the material to prevent leaks, and allowing for efficient water transfer. Additionally, the system includes a drain to catch particulates, ensuring the transferred water remains clean.

Other objects will become evident as the present invention is described in detail below.

BRIEF DESCRIPTION OF THE DRAWINGS

Embodiments of the present application are described herein in which similar elements are given similar reference characters, and a more complete understanding of the present invention, and the attendant advantages and features thereof, will be more readily understood by reference to the following detailed description when considered in conjunction with the accompanying drawings wherein.

DETAILED DESCRIPTION OF THE INVENTION

Figure 1:
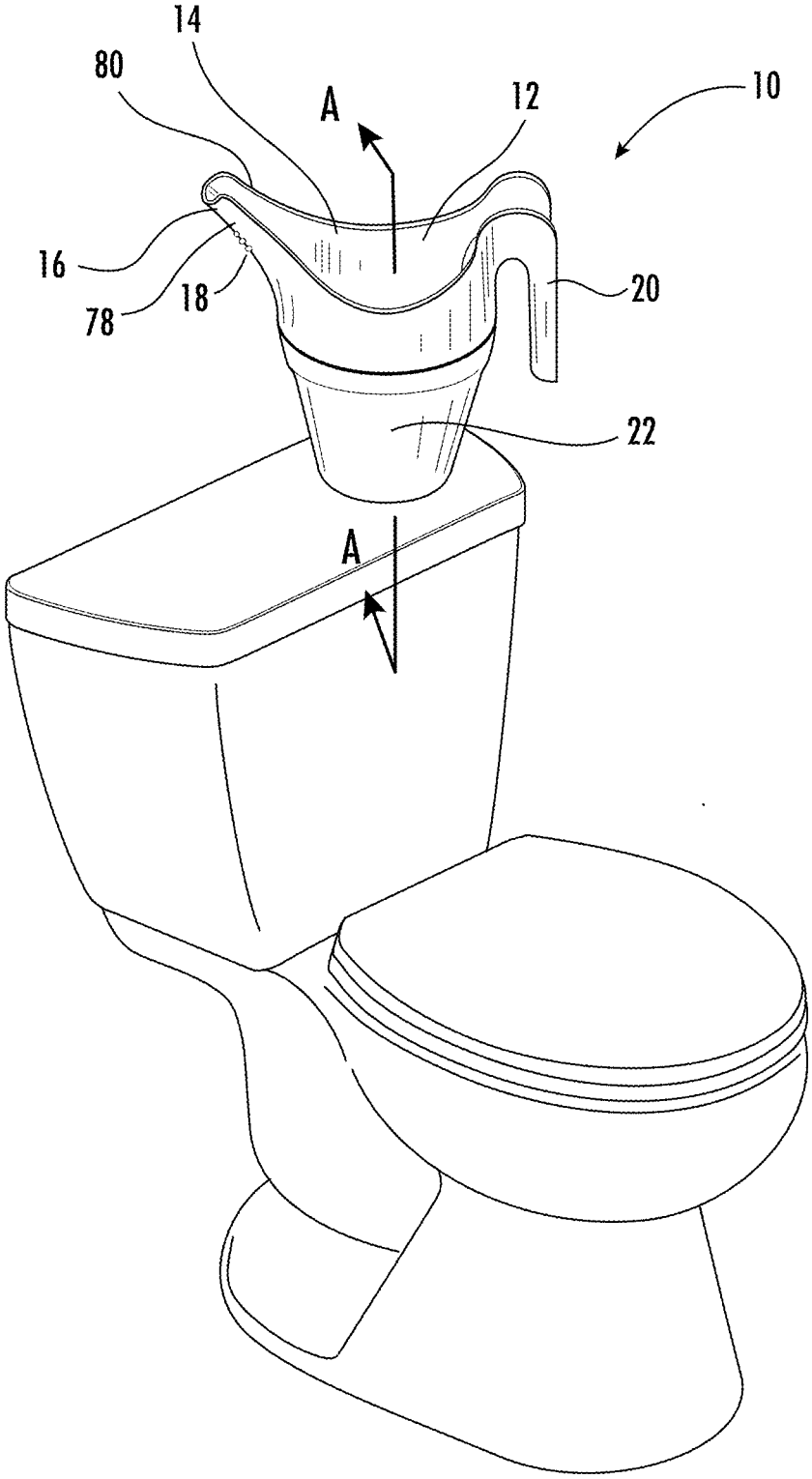
FIG. 1 is a perspective view of one embodiment of a shower pot system for reclaiming water depicting the first receptacle for storing water nested with a second receptacle secured with a toilet for directing water into the water tank of a toilet.

The present invention advantageously provides a system and method for reclaiming and utilizing water that is normally wasted during showering, for the purpose of flushing toilets. The present invention contemplates various types of receptacles, flow control devices, and attachment mechanisms to adapt to different shower and toilet configurations, ensuring compatibility and ease of use in a wide range of bathroom environments.

Accordingly, the system and method components have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

Referring now to the drawing figures in which like reference designators refer to like elements. FIG. 1 shows an exemplary water recycling system constructed in accordance with the principles of the present invention and designated generally as water recycling system 10. In particular, water recycling system 10 includes a first receptacle 12 provided for collecting and temporarily storing water, such as shower water. The first receptacle 12 includes an inner receptacle basin 14 for holding liquid. The first receptacle 12 further includes a spout 16, the spout 16 is formed to be gripped by the hand of a user. The spout 16 includes one or more notches 18 for aiding the two handed grip of a user when or holding the first receptacle 12 via the spout 16 due to the weight of water. The first receptacle 12 further includes a handle 20 for gripping the first receptacle 12 by another hand of a user. In operation, a user can place the first receptacle 12 on the floor of the shower or tub during bathing, including while the shower is warming up, to fill up the receptacle basin 14. The user can grip the spout 16 and the handle 20 for carrying the first receptacle 12 back to a second receptacle 22 for storage.

Still referring to FIG. 1, the first receptacle 12 is designed to nestle in a close snug fit into the second receptacle 22 when not in use. The first receptacle 12 and the second receptacle 22 may be constructed of a durable and waterproof material, such as plastic, resin, metal, or other capable materials, with the first receptacle equipped to be repeatedly filled with a water source, such as the shower, stored in the second receptacle 22, and then poured into the second receptacle 22 at the point in which the toilet is flushed.

The second receptacle 22 is configured to receive the first receptacle 12 when nested together.

Figure 2:
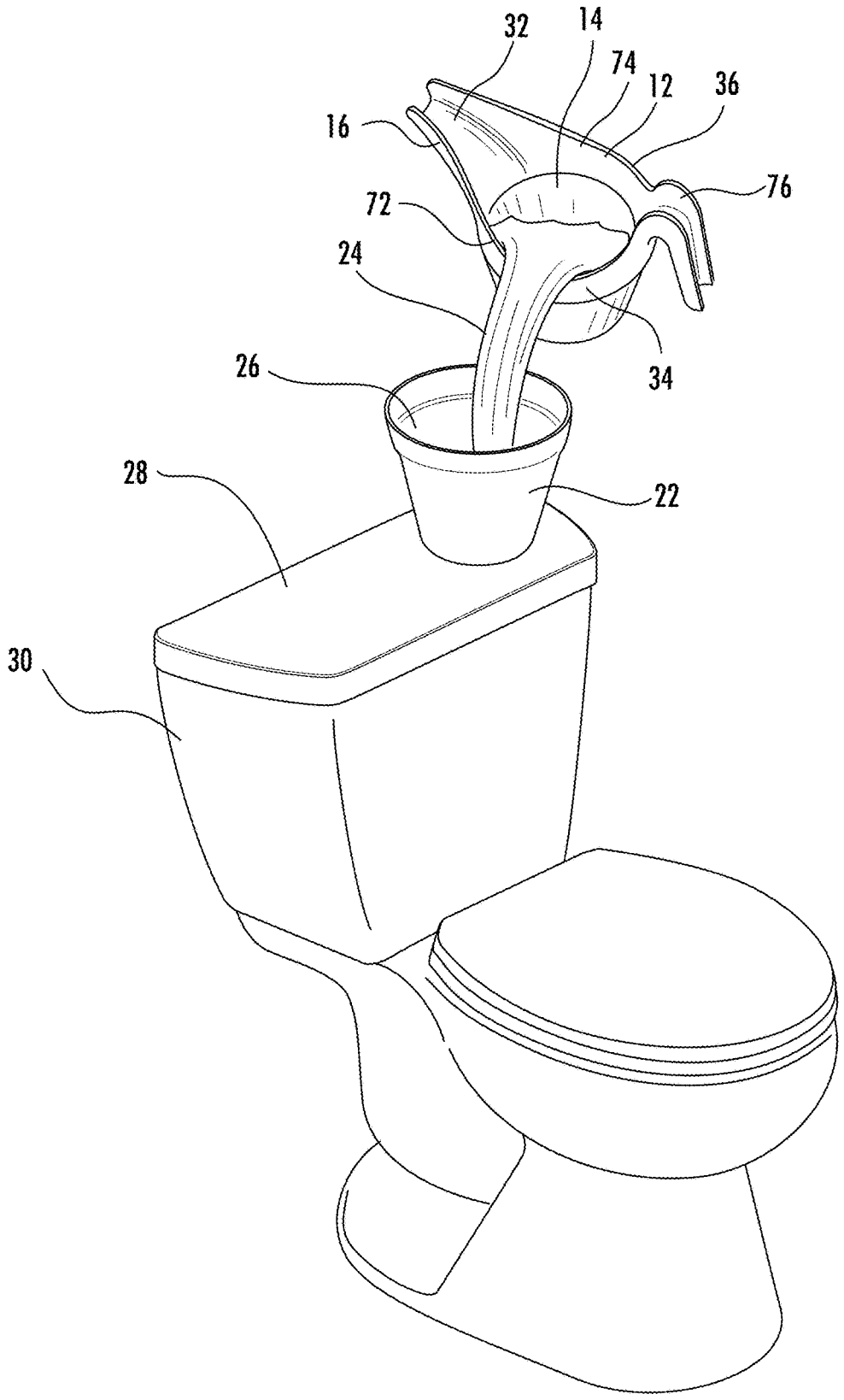
FIG. 2 is a perspective view of one embodiment of a shower pot system of FIG. 1 for reclaiming water depicting the first receptacle for pouring water into a second receptacle secured with a toilet for directing water into the water tank of a toilet.

Referring now to FIG. 2, a perspective view of one embodiment of a shower pot system for recycling water depicting the first receptacle 12 for storing water in the receptacle basin 14 has been lifted by a user and is shown with water 24 being redistributed from the receptacle basin 14 to the inner hopper 26 second receptacle 22. The inner hopper 26 of the second receptacle 22 feeds water through the toilet lid 28 into the toilet water tank 30. In operation, pouring water from the first receptacle 12 through the inner hopper 26 to the toilet water tank 30 will quickly fill up the toilet water tank and thereby quickly shutting off the flow of clean municipal water and/or otherwise abbreviating the flow of the conventional fill system, or other clean water.

Still referring to FIG. 2, in yet another non-limiting embodiment of the present embodiment, the water is dumped along a side edge 34 of the upper rim 36 of the first receptacle 12. In one non-limiting embodiment (not shown), the user can pour the water along the inner surface 32 of the spout or easily from either side.

Figure 3:
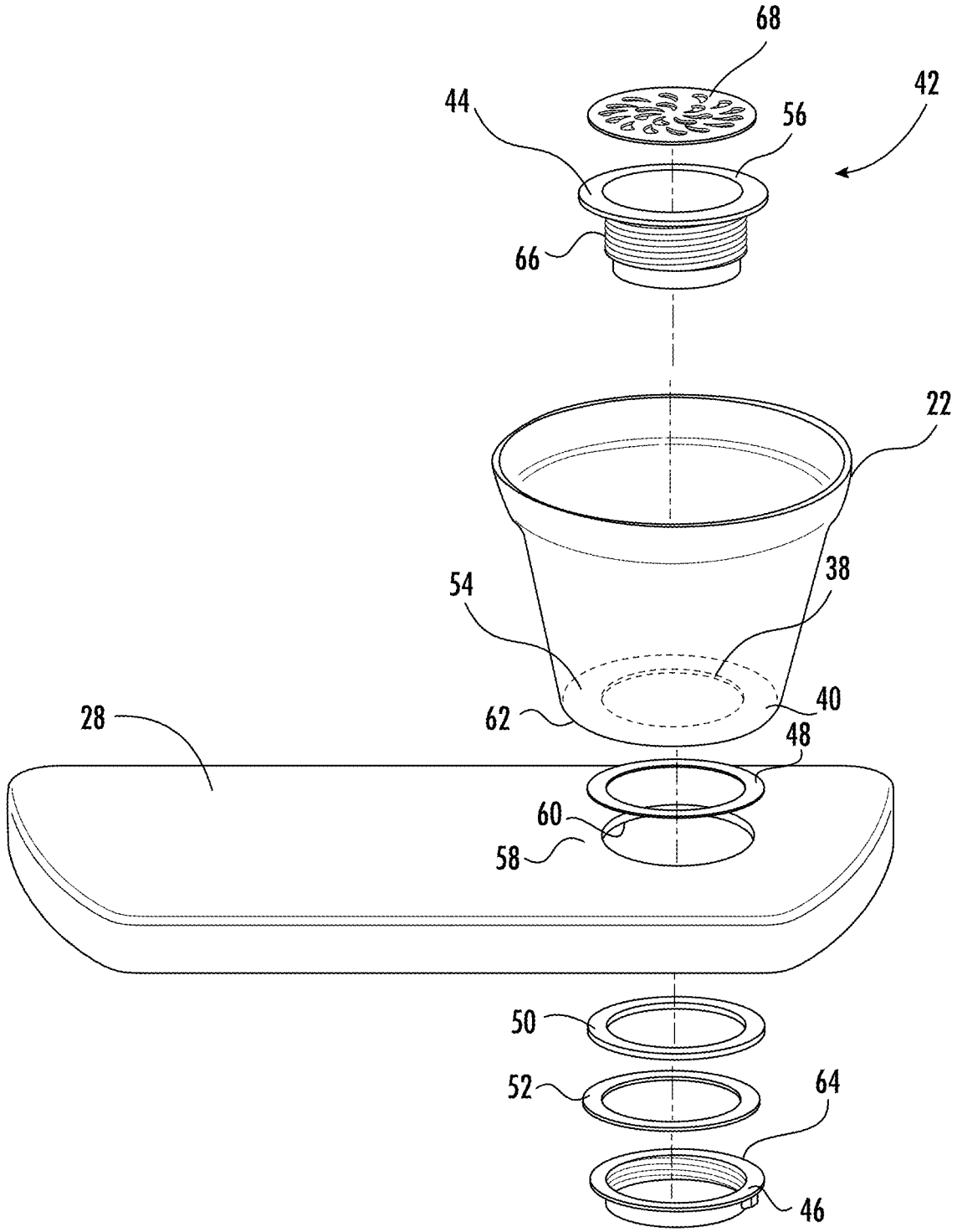
FIG. 3 is an exploded view of the second receptacle of FIG. 1.

Referring now to FIG. 3, the second receptacle 22 includes an inner central aperture 38 at the bottom 40 that facilitates passage of the liquid from the first receptacle 12 to the toilet water tank 30. The second receptacle 22 secures with the toilet tank lid 28 and/or the toilet water tank 30 directly depending on the toilet model. The inner central aperture 38 provides a passage for liquid from the second receptacle 22 to the toilet water tank 30.

Still referring to FIG. 3, an exploded view of a securement device 42 is shown that includes an upper drain body 44, a lower drain nut 46, and multiple washers 48, 50, and 52 for providing a water seal of the water recycling system 10 with the toilet tank lid 28. The second receptacle 22 includes an upper facing surface 54 of the bottom 40. Plumber's putty may be used between the upper drain body 44 and the second receptacle 22. The first washer 48 is placed along the male reciprocating threading 66 of the upper drain body 44 to be sandwiched with a lower facing surface 62 and an upper facing toilet tank surface 58 for providing a water tight seal between the second receptacle 22 and the toilet tank lid 28. The second and third washers 50 and 52 are sandwiched between the lower facing surface 60 of the toilet tank lid 28 and the rim 64 of the lower drain nut 46. The male reciprocating threading 66 of the upper drain body 44 and the female reciprocating threading of the lower drain nut 46 are rotatably drawn together to cinch the second receptacle 22 with the toilet water tank lid 28 providing a water tight seal via the multiple washers 48, 50, and 52. The securement device 42 further including a drain 68 about the upper drain surface 56 for catching hair and other particulates.

Figure 4:
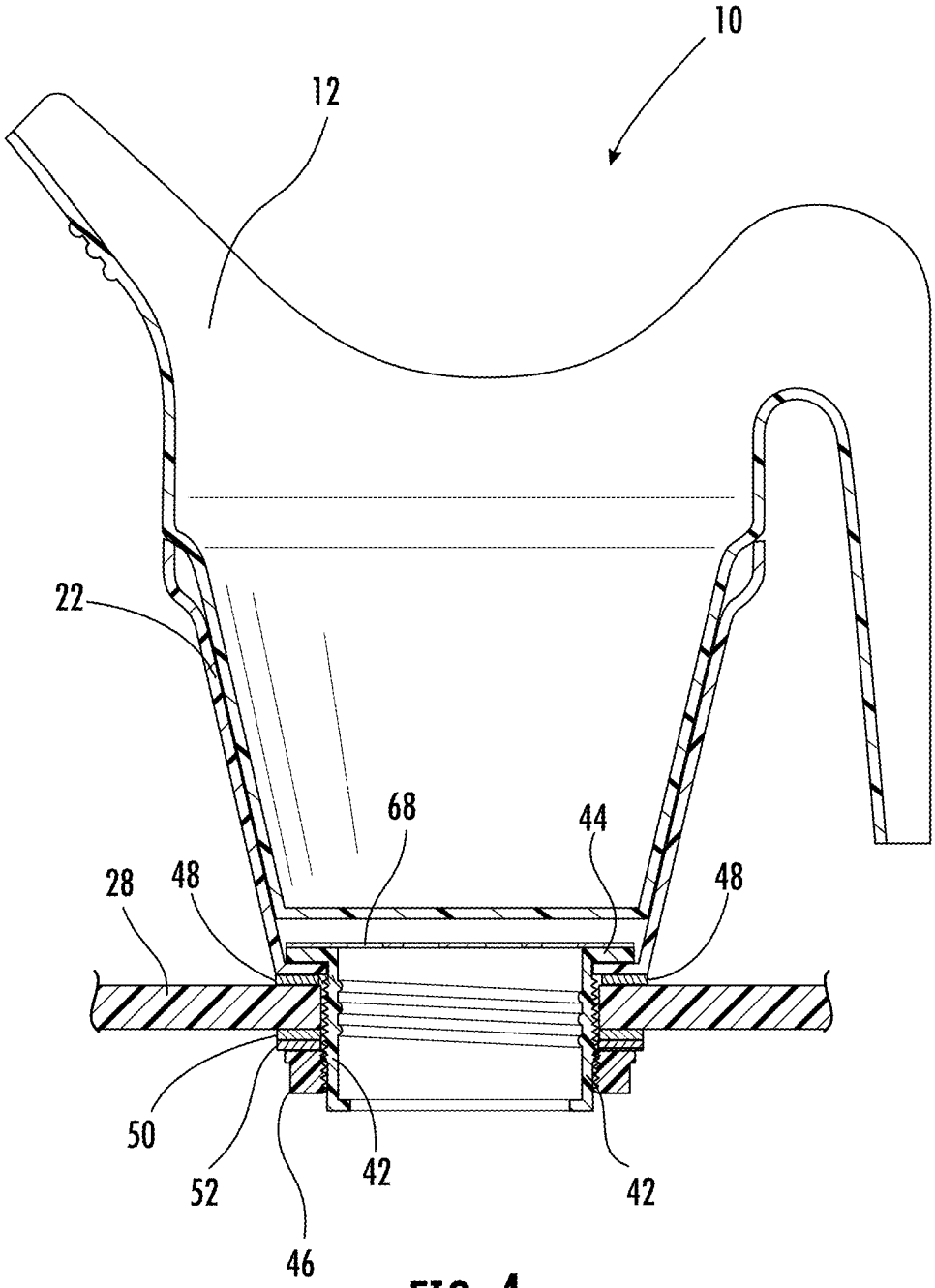
FIG. 4 is a cross-sectional view of the shower pot system taken along line A-A of FIG. 1.

Referring now to FIG. 4, a cross-sectional view taken along line A-A of FIG. 1 is shown having the first receptacle 12 nested in the second receptacle 22. The second receptacle 22 is shown sitting on the toilet tank lid 28 secured via the securement device 42 with the upper drain body 44 and the lower drain nut 46 with the male and female reciprocating threading rotatably cinched together, and with the multiple washers 48, 50, and 52 for providing a water tight seal, and the drain 68.

In operation, a user takes a shower, uses the sink, or even leaves the first receptacle 12 outside when it rains, and the shower water is collected in the first receptacle 12. After the user is done collecting water from a water source, the user lifts the first receptacle 12 and places it nested in the second receptacle 22 until it is time to flush the toilet. When the toilet is flushed, the user will simultaneously or just there-after pour the water from the first receptacle 12 into the second receptacle 22 which will drain through the securement device 42 into the toilet water tank 30 from the second receptacle 22. The reclaimed water is then used to refill the toilet water tank 30 for the next flush and thereby blunting the flow of fresh municipal, or other, water into the toilet water tank 30 thereby conserving water.

In one non-limiting embodiment, the user may pour water out from the first receptacle 12 from any of the inner surface of the spout 16, the surface 76 from the handle 20, the left side 72, or the right side 74 (See FIG. 2).

In one non-limiting embodiment, the spout 16 is constructed and shaped to capture and direct water from a bathtub water spout to the spout 16 when the first receptacle 12 is placed in a bathtub.

In one non-limiting embodiment, the water recycling system 10 is constructed and arranged to be used without any municipal water source.

In one non-limiting embodiment, the outer wall edges 78, 80 are flanged to allow stacking of a plurality of first receptacles 12.

Figure 5:
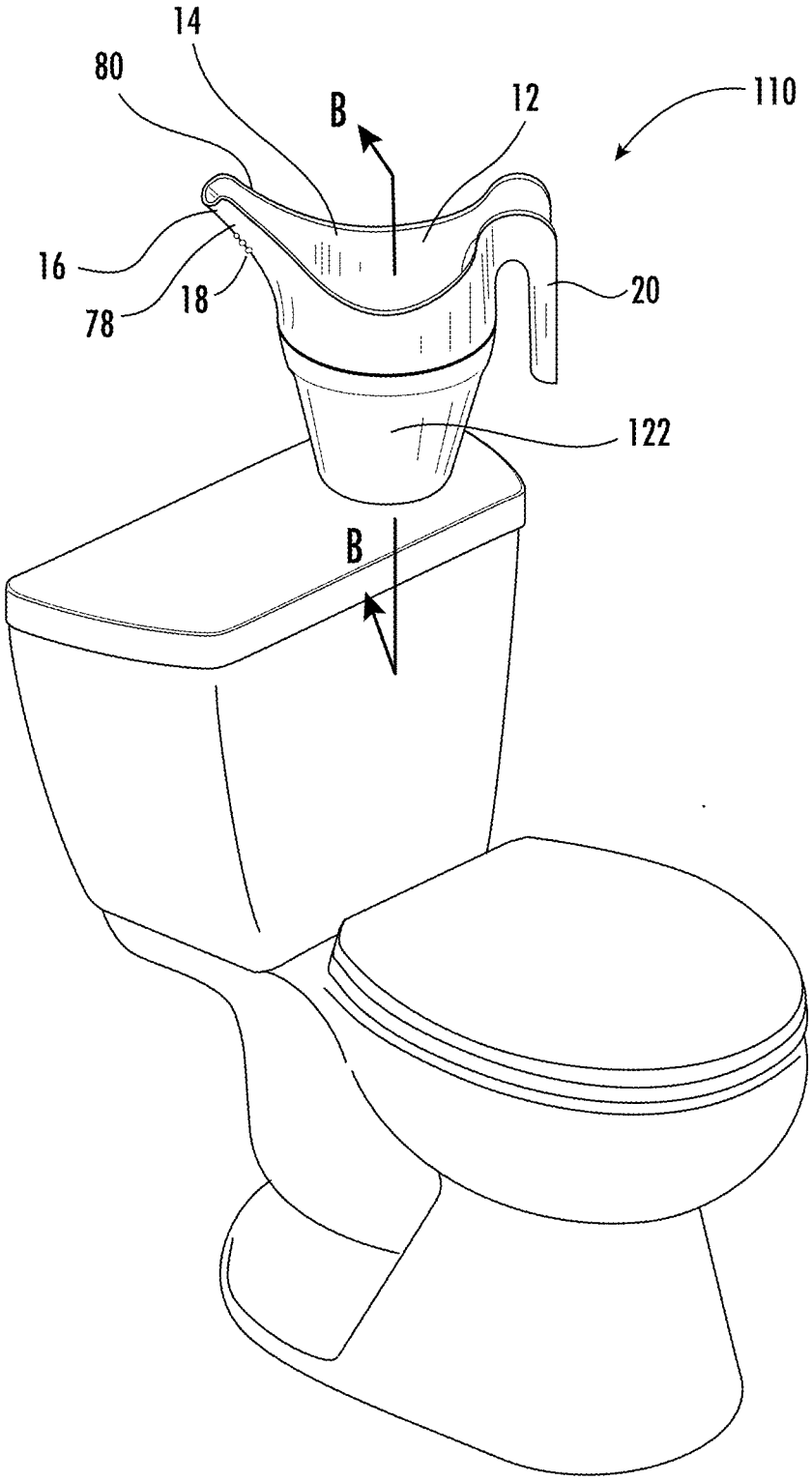
FIG. 5 is a perspective view of one alternate embodiment of a shower pot system for reclaiming water depicting the first receptacle for storing water nested with a second receptacle secured to a toilet for directing water into the water tank of a toilet.

Referring now to FIG. 5, an alternate embodiment of the water recycling system 10 is now shown as water recycling system 110. Water recycling system 110 shown in FIG. 5 in this view is no different than that embodiment shown in FIG. 1. The difference lies in the structure of the second receptacle 122 in the way it secures with a toilet lid, further shown in FIGS. 6-7. Water recycling system 110 includes the same first receptacle 12 disclosed previous provided for collecting and temporarily storing water, such as shower water. The first receptacle 12 includes the inner receptacle basin 14 for holding liquid. The first receptacle 12 further includes the spout 16, the spout 16 is formed to be gripped by the hand of a user. The spout 16 includes one or more notches 18 for aiding the grip of a user when two handed holding of the first receptacle 12 via the spout 16 due to the weight of water. The first receptacle 12 further includes the handle 20 for gripping the first receptacle 12 by another hand of a user. In operation, a user can place the first receptacle 12 on the floor of the shower or tub during bathing, including while the shower is warming up, to fill up the receptacle basin 14. The user can grip the spout 16 and the handle 20 for carrying the first receptacle 12 back to a second receptacle 122 for storage.

Still referring to FIG. 5, the first receptacle 12 is still designed to nestle in a close snug fit into the second receptacle 122 when not in use. The first receptacle 12 and the second receptacle 122 may be constructed of a durable and waterproof material, such as plastic, resin, metal, or other capable materials, with the first receptacle equipped to be repeatedly filled with a water source, such as the shower, stored in the second receptacle 122, and then poured into the second receptacle 122 at the point in which the toilet is flushed.

Figure 6:
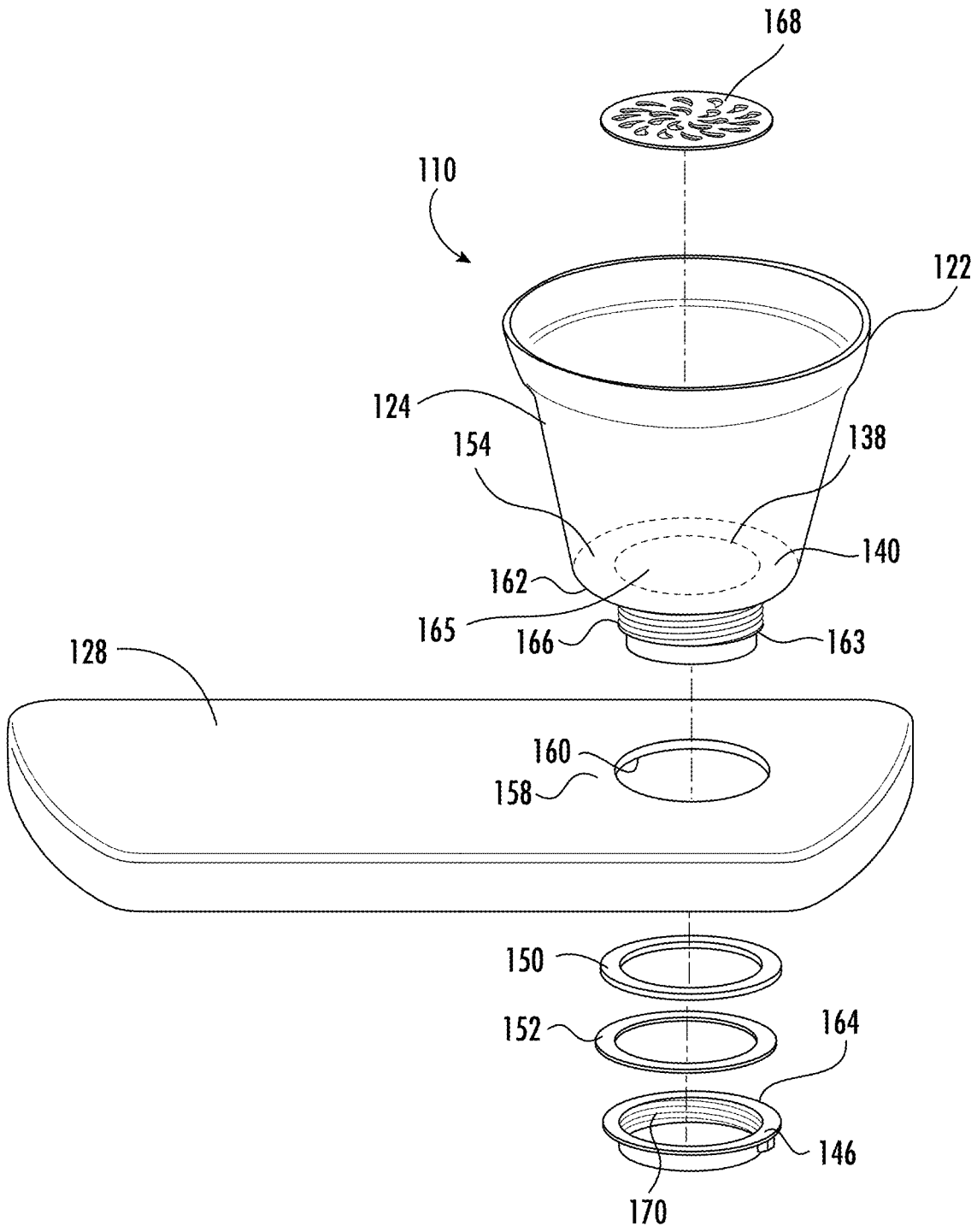
FIG. 6 is an exploded view of the second receptacle of FIG. 1.

Referring to FIG. 6, an alternate embodiment of the water recycling system 110 is shown with an exploded view of the second receptacle 122. The second receptacle includes an outer wall 124 formed with a bottom 140. The bottom 140 having a width extending to an inner central aperture 138. A throat 163 extending downward from the bottom 140 creating a channel 165 for allowing water to pass through a toilet tank lid 128. The throat 163 includes male reciprocating threading 166. The second receptacle 122 further includes a lower drain nut 146, and optionally washers 150 and 152 for securing the throat 163 through the toilet tank lid 128. The washers 150 and 152 are positioned between the lower drain nut 146 and the toilet tank lid 128 to ensure a tight seal. The arrangement of this embodiment allows for efficient water flow from the second receptacle 122 into the toilet tank while minimizing potential leaks. The second receptacle 122 is designed to be easily removable for cleaning, maintenance or replacement, providing a practical solution for recycling water and reducing overall water usage.

In an optional non-limiting embodiment, the washers 150 and 152 are sandwiched between the lower facing surface 160 of the toilet tank lid 128 and the rim 164 of the lower drain nut 146. The male reciprocating threading 166 of the throat 163 and the female reciprocating threading 170 of the lower drain nut 146 are rotatably drawn together to cinch the second receptacle 122 with the toilet water tank lid 128 providing a water tight seal, and may include the option washers 150, and 152 to assist in creating a tight seal. The second receptacle 122 optionally includes a drain 168 placed about the upper surface 154 for catching hair and other particulates.

Figure 7:
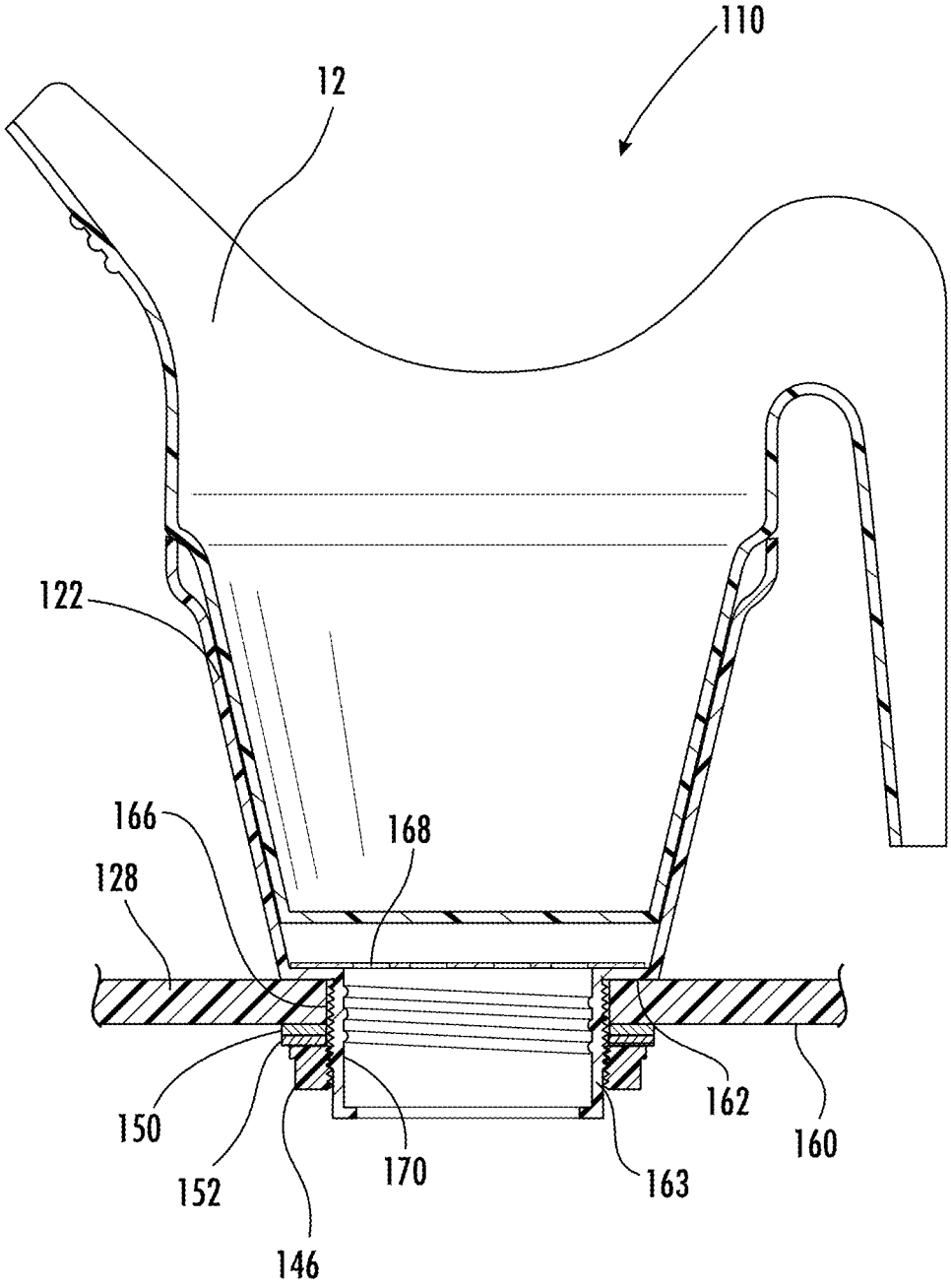
FIG. 7 is a cross-sectional view of the shower pot system taken along line B-B of FIG. 5.

Referring now to FIG. 7, a cross-sectional view taken along line B-B of FIG. 5 is shown having the first receptacle 12 nested in the second receptacle 122. The second receptacle 122 is shown sitting on the toilet tank lid 128 secured with the throat 163 extending through an aperture in the toilet tank lid 128 via the lower drain nut 146 about the reciprocating threading 166 and 170. The male and female reciprocating threading rotatably cinched together, and optionally with the washers 150, and 152 for providing a tight seal. The second receptacle 122 optionally including a drain 168.

As used herein, when the term "and/or" is used, it shall include all combinations of one or more of the associated described items.

It will be appreciated by persons skilled in the art that the present invention is not limited to what has been particularly shown and described herein above. In addition, unless mention was made above to the contrary, it should be noted that all of the accompanying drawings are not to scale. A variety of modifications and variations are contemplated in light of the above teachings without departing from the scope and spirit of the invention. It will be readily apparent that various changes may be made thereto without departing from the spirit and scope of the disclosure or sacrificing all of its material advantages. The examples and embodiments described herein are merely exemplary of the instant disclosure.

What is claimed is:

1. A water recycling system for toilets, comprising: a first receptacle for collecting shower water; a second receptacle into which said first receptacle nests, an aperture on said second receptacle for allowing water passage into the toilet tank during flushing, said second receptacle being secured to a toilet tank cover, said second receptacle having an outer wall and a bottom that extends to form an inner central aperture, a throat extending from said bottom and equipped with male reciprocating threading, a lower drain nut interfacing with said threading, secured by washers, to form a channel for water to flow into a toilet tank; and wherein said throat ensures a passage point from said second receptacle through the toilet tank cover to prevent leaks as water passes to the toilet tank.

* * * * *